US006520829B1

(12) United States Patent
Temple

(10) Patent No.: US 6,520,829 B1
(45) Date of Patent: Feb. 18, 2003

(54) TOY RACING SET

(75) Inventor: Kenneth D. Temple, Twinsburg, OH (US)

(73) Assignee: The Little Tikes Company, Hudson, OH (US)

( * ) Notice: Subject to any disclaimer, the term of this patent is extended or adjusted under 35 U.S.C. 154(b) by 0 days.

(21) Appl. No.: 09/628,268

(22) Filed: Jul. 28, 2000

(51) Int. Cl.[7] ..... A63H 17/05
(52) U.S. Cl. ..... 446/434
(58) Field of Search ..... 446/434, 409, 446/436, 435, 4, 6, 75

(56) References Cited

U.S. PATENT DOCUMENTS

| | | | | | |
|---|---|---|---|---|---|
| 2,218,394 | A | | 10/1940 | Elliot | |
| 2,994,159 | A | * | 8/1961 | Bonidie | 446/435 |
| 3,039,229 | A | | 6/1962 | Cleemput | |
| 3,594,951 | A | * | 7/1971 | Perhacs, Jr. | 446/434 |
| 3,675,366 | A | * | 7/1972 | Tomiyama | 446/434 |
| 4,187,636 | A | | 2/1980 | Pauly | |
| 4,194,318 | A | * | 3/1980 | Watanabe | 446/435 |
| 4,219,962 | A | * | 9/1980 | Dankman et al. | 446/409 |
| 4,249,339 | A | * | 2/1981 | Crain et al. | 446/435 |
| 4,274,225 | A | * | 6/1981 | Knauff et al. | 446/409 |
| 4,349,983 | A | | 9/1982 | Kilroy et al. | |
| 4,433,504 | A | | 2/1984 | Terui | |
| 4,505,686 | A | | 3/1985 | Mariol | |
| 4,516,948 | A | | 5/1985 | Obara | |
| 4,708,683 | A | | 11/1987 | Lehman et al. | |
| 4,869,701 | A | * | 9/1989 | Kawai et al. | 446/321 |
| 4,905,828 | A | | 3/1990 | Dods | |
| 5,037,302 | A | * | 8/1991 | Sirota | 446/474 |
| 5,195,920 | A | * | 3/1993 | Collier | 446/409 |
| 5,529,454 | A | * | 6/1996 | Alm et al. | 414/478 |
| 5,908,345 | A | * | 6/1999 | Chio | 446/436 |
| 6,200,193 | B1 | * | 3/2001 | Nadel | 446/409 |

FOREIGN PATENT DOCUMENTS

| | | | |
|---|---|---|---|
| GB | 711289 | * | 8/1952 |
| GB | 957006 | * | 5/1962 |

* cited by examiner

*Primary Examiner*—Derris H. Banks
*Assistant Examiner*—Faye Francis
(74) *Attorney, Agent, or Firm*—Piper Rudnick

(57) ABSTRACT

A model racing toy including a convertible model transport vehicle, a model vehicle and model vehicle accessories. The model transport vehicle may be converted by means of a push button or other such device into a model racing pit stop. The convertible transport includes a storable deployment ramp which is ejected when the conversion button is pressed, allowing the model vehicle to move from an exemplary position atop the model transport vehicle. The vehicle is equipped with activation points, motors and a speaker. The activation points compose a variety of different switches, designed to resemble vehicle parts. When a specific activation point is activated, it triggers a series of actions by the motors and speaker, prompting the user to make certain repairs. The successful making of repairs activates other activation points, which provide affirming messages and vehicle motion to simulate the continuance of a race after repair has been made.

7 Claims, 3 Drawing Sheets

TOY RACING SET

FIELD OF THE INVENTION

The present invention relates generally to the field of model vehicle toys. More particularly, the invention relates to a model race car with a convertible transport configured to simulate a racing team environment.

BACKGROUND OF THE INVENTION

Children enjoy model vehicles, the excitement of a race and the opportunity to play with mechanically-oriented toys. Furthermore, playing with spatially and mechanically challenging toys has been found to stimulate cognitive abilities. The present invention therefore attempts to combine the excitement of car racing with the mechanical challenge of vehicle repair in the form of a toy for children.

A multitude of model vehicle toys have been produced since the invention of vehicles themselves. Most of these have been limited to simple models of the outward appearance of the vehicle. A few more recent toys have had some level of interactivity, including motion and sound, produced on command from the user. Other vehicular toys have shown conversion capabilities, such as for example, trucks that can unfold into robots and vehicles that can be hidden inside other vehicles. Still other toys give children an opportunity to create things with their hands, thereby stimulating creative learning and providing enjoyment for the child. Some of these toys have also involved repairing mechanical devices. No toy, however, has provided an atmosphere where the child's contributions lead to success in an exciting team racing environment.

The present invention seeks to combine an interactive race car model toy with a convertible transport carrier, while at the same time providing a simulated race and racing team environment. This system also challenges the child to make simple repairs under time pressure. The toy is especially advantageous in that the child sees the fruits of his or her labors when a repaired racing vehicle re-enters a race.

It is therefore an object of the present invention to provide an improved toy which challenges a child to achieve a specific goal through creative interaction.

It is another object of the present invention to provide a toy that stimulates learning.

It is another object of the present invention to provide a toy that captures the excitement of a race and a racing team environment.

It is another object of the present invention to provide a toy that allows children to make simplified repairs to a racing vehicle resulting in resuming the race.

It is another object of the present invention to provide a toy that can simulate a variety of vehicle malfunctions and instruct the child on which defect to repair.

It is another object of the present invention to provide accessories to the racing vehicle that make simulated repairs more realistic.

It is a further object of the present invention to provide a transport vehicle which can be quickly converted to a racing pit stop.

It is a further object of the present invention to provide vehicles and accessories that prompt a child to make repairs to a racing vehicle, encourage the child through audible cues and vehicle motion and to provide excitement during play.

SUMMARY OF THE INVENTION

According to one aspect of the present invention, a model racing toy includes a convertible model transport vehicle, a model vehicle and model vehicle accessories. The model transport vehicle can be converted by means of a push button or other such device into a model racing pit stop. In one preferred embodiment, the convertible transport also contains a storable deployment ramp which is ejected when the conversion button is pressed, allowing the model vehicle to move from a position atop the model transport vehicle.

According to another aspect of the present invention, a model vehicle is equipped with activation points, motors and a speaker. The activation points comprise a variety of different switches which are designed to resemble actual vehicle parts. When a specific activation commences, and an activation point is actuated, a series of actions are triggered via the motors and speaker, prompting the user to make certain repairs. In a successful repair other activation points are actuated, which provide affirming messages to the child and vehicle motion simulates the continuance of a race after the repair has been made.

BRIEF DESCRIPTION OF THE DRAWINGS

The invention will become more fully understood from the following detailed description, taken in conjunction with the accompanying drawings, wherein like reference numerals refer to like parts, and in which.

DETAILED DESCRIPTION OF THE INVENTION

Figure 1:
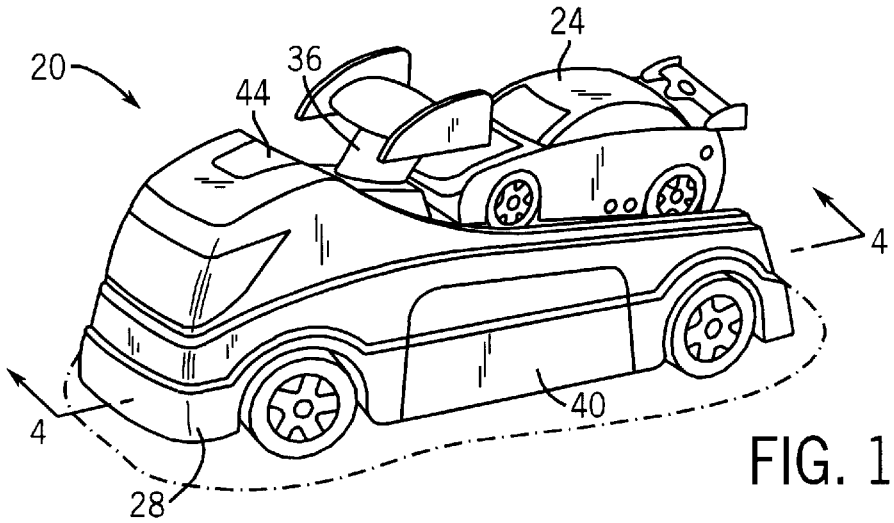
FIG. 1 is a perspective view of a preferred embodiment, showing a model vehicle being carried by a model transport vehicle.
Figure 2:
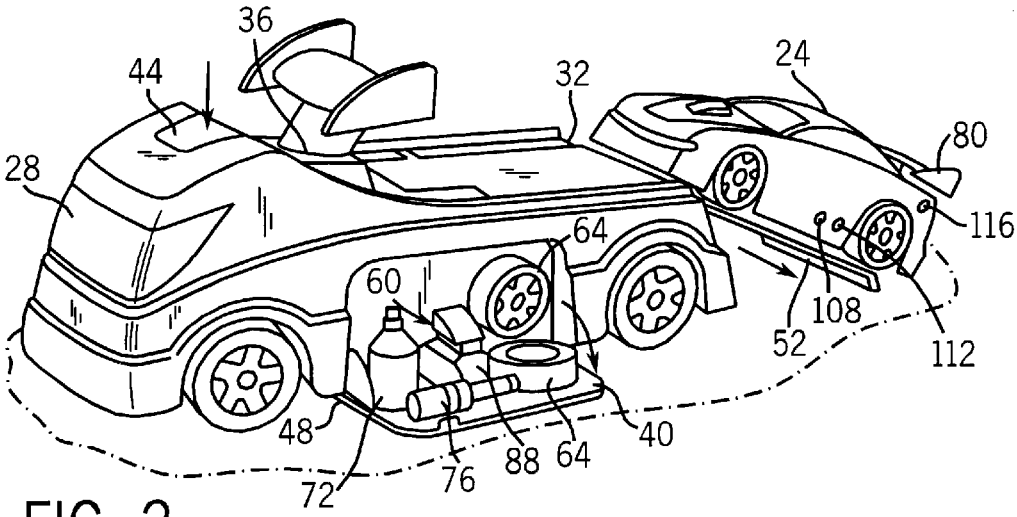
FIG. 2 is a perspective view of a preferred embodiment, showing a model vehicle deploying from the transport vehicle and a deployed repair compartment.

A model toy racing set 20 constructed in accordance with the invention is shown in FIG. 1. Model vehicle 24 is positioned atop model transport vehicle 28, in an exemplary transport position, held in place by transport wing 36 and wheel barrier 32, which is best shown in FIG. 2. Racing pit door 40 is shown in its closed position in FIG. 1. As shown in FIG. 2, activation of functionalities and conversion of the model transport vehicle 28 can be accomplished by pressing push button 44, which causes the downward opening of racing pit door 32 by rotation around pit door hinge 48. Deployment ramp 52 is also deployed by the activation of the push button 44, sliding out from the interior of the transport vehicle 28. The deployment ramp 52 serves to allow the model vehicle 24 to move from the surrounding ground 56 to its exemplary transport position atop model transport 28 in a smooth rolling motion, that is, as a real vehicle might move.

FIG. 2 also shows a number of various model vehicle accessories 60 located behind racing pit door 40 that appear upon pressing push button 44, which may be used with this embodiment. The model vehicle accessories 60 shown in FIG. 2 can include, for example, model spare tires 64, model replacement engine 88, model gas can 72, model headlights 93 and 95 and model hex-wrench 76. In the present embodiment, the model vehicle accessories 60 are coupled to various attachment points (not shown). In this preferred embodiment, attachment is accomplished by a plastic peg attachment point that fits into a corresponding hole in each model vehicle accessory. Numerous such attachment schemes, however, are possible and will be ascertainable to those of skill in the art.

Figure 3:
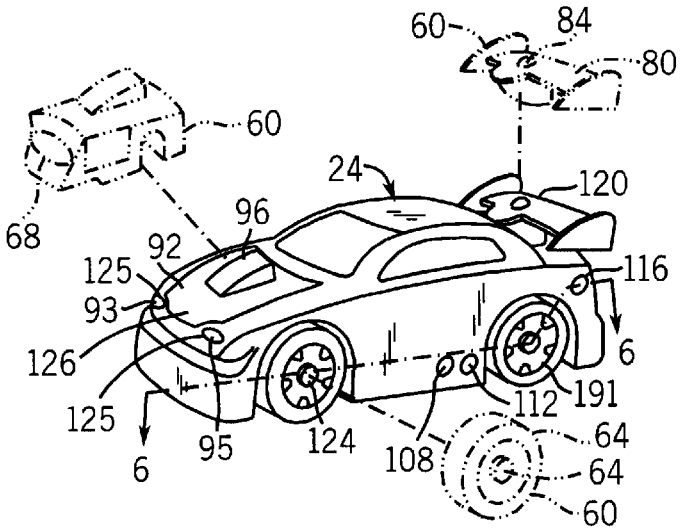
FIG. 3 is a perspective view of a model vehicle of a preferred embodiment, showing detachable model vehicle accessories.

FIG. 3 further illustrates the model vehicle 24 and the various model vehicle accessories 60. Model vehicle wing 80 can be removed by loosening hex bolt 84, which can be accomplished with hex-wrench 76 (shown in FIG. 2). The model replacement engine 88 can be removed by lifting model vehicle hood 92 by means of hood catch 96, and pulling the replacement engine 88 from within the engine compartment (not shown). The replacement engine 88 can be attached through the above described attachment scheme used with the model vehicle accessories 60. In this embodiment, model vehicle front tires 100 can be removed by loosening the hex bolt 104, by means of the hex wrench 76 (shown in FIG. 2).

FIG. 3 also shows model activation points 108, 112, 116, 120, 124 and 125 of the model vehicle 24 of the present embodiment. These various activation points, which also may be referred to as part of overall activation systems, can be activated by the user to invoke functions of the model vehicle 24. For example, the model vehicle activation points 108, 112 and 116 are buttons, which can be depressed. The activation points 120 and 124 are hex bolt sensors which are activated by the loosening of the hex bolts 84 and 104, respectively. The model vehicle 24 can also have activation points 125 for the headlights 93 and 95, respectively. Another activation point 126 present in the interior of the model vehicle hood space is activated by the removal of the replacement engine 88. In one embodiment of the invention, activation points 120 and 124 resemble actual vehicle components, but it is also possible to have such points resemble other items or to resemble words that describe the component that is supposed to be manipulated by the user. Numerous types of such activation points are possible and will be readily ascertainable to those of skill in the art.

Figure 4:
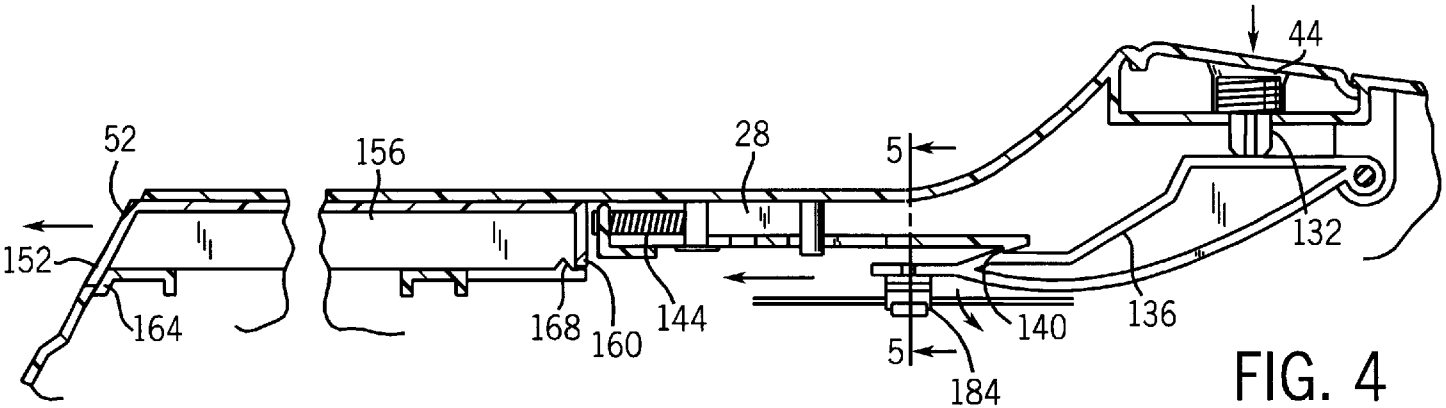
FIG. 4 is a partial vertical cross-sectional view along the 4—4 axis shown in FIG. 1, showing the interior of a model transport vehicle of a preferred embodiment.

FIG. 4 shows an interior vertical cross section of the transport vehicle 28, along the 4—4 axis as shown in FIG. 1. The push button 44 serves as a means to initiate the conversion from a transport vehicle to a racing pit environment (see FIGS. 1 and 2 for reference). The function of push button 44 could be accomplished by any of a variety of means ascertainable to those of skill in the art, including levers, retractable buttons, dials, slideable blocks, pins, wheels, rods, pulleys. Electronic or motor means are also possible. In this embodiment, depressing the push button 44 forces pin 132 downward, in turn deforming member 136. Deformation of member 136 causes catch 140 to disengage, thus allowing the release of spring 144. The spring 144 is an example of an actuating device, which may be used in conjunction with the embodiments to facilitate conversion to a model racing pit. Other actuating devices can include, for example, a deformed rod or member with good elastic memory, a motor or a chemical or electrochemically expansive material. The spring 144 thus releases and expands against interior horizontal edge 148 of the deployment ramp 52, shown in its fully closed position. When in the fully closed position, the deployment ramp 52 is completely within the model transport vehicle 28, such that only the exterior angled edge 152 of the deployment ramp 52 is visible. The deployment ramp 52 is slideably attached to deployment ramp exit cuff 156 of the model transport vehicle 28, and through the release of the spring 144, is forcibly ejected through the exit cuff 156. Stop 160 serves to prevent the deployment ramp 52 from becoming detached from the transport vehicle 28 upon conversion, by breaking against another stop 164. As the deployment ramp 52 exits the transport vehicle 28, gravity pulls the leading edge downward, causing the deployment ramp 52 to rotate outward and into the fully open position shown in FIG. 2. When the deployment ramp 52 is in its fully open position (as shown in FIG. 2), it may be reset to its fully closed position (as shown in FIGS. 1 and 4) by pressing on the exterior angled edge 152 until the interior horizontal edge 148 recompresses the spring 144 and the catch 140 re-engages. The catch 168 is a minimal friction catch, serving to hold the deployment ramp 52 in place against the force of gravity should the transport vehicle 28 be lifted and rotated.

Figure 5:
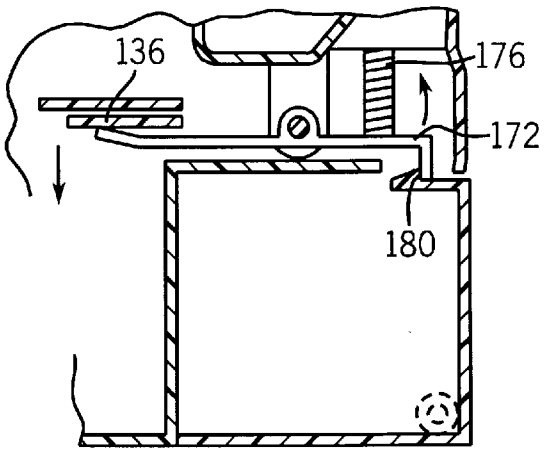
FIG. 5 is a vertical cross-sectional view along the 5—5 axis shown in FIG. 4, showing detail of a model transport vehicle conversion mechanism of a preferred embodiment.

FIG. 5 shows a vertical cross section of the transport vehicle 28, taken along the 5—5 axis shown in FIG. 4. When the push button 44 is pressed, the deforming member 136 presses on hinged bar member 172, which rotates in the direction of the arrows, working against spring 176. This action serves to release catch 180. Hinge 184 is placed slightly to the interior of the racing pit door 40, allowing weight on the interior side of the racing pit door 40 to produce an opening torque around hinge 184.

Figure 6:
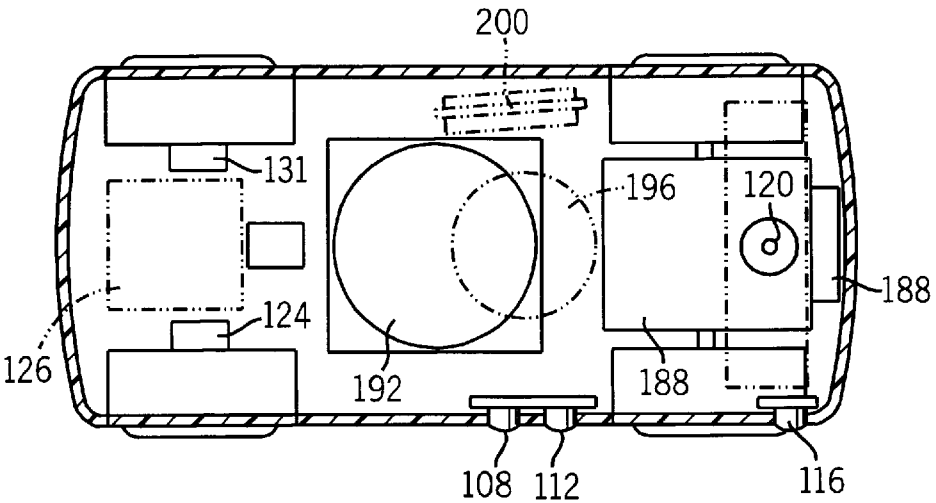
FIG. 6 is a horizontal cross-sectional view along the 6—6 axis shown in FIG. 3, showing interior detail of a model vehicle of a preferred embodiment.

FIG. 6 is a horizontal cross section taken along the 6—6 axis as shown in FIG. 3 of the model vehicle 24. Switch 188 is an on-off-demo switch, serving as the primary power connection switch. The activation points 108 and 112 are "race begin" and "repair begin" switches, respectively. These activation points 108 and 112 are shown as button devices in the preferred embodiment. The activation point 116 is a refuel switch, also shown as a button. The activation point 120 is the stabilizing wing switch, shown as a hex-bolt release detector. This wing switch closes when the stabilizing wing hex bolt 84 has been loosened to a sufficient degree. The activation points 124 are wheel bolt switches, shown as a hex bolt release detectors, which close when wheel hex bolts 104 are loosened to a sufficient degree directly over the activation point 124. An activation point 126 for the engine switch is closed when the engine is sufficiently loosened from its attachment points. The activation points of the present embodiment have been designated to simulate vehicle components. For example, the activation points 120 and 124 appear from the outside to be actual bolts. The activation point 116 appears in the position where a vehicle's fuel tank opening would normally appear. The activation point for the engine is not visible, being located underneath the model vehicle replacement engine 88.

Also shown in FIG. 6 are a number of mechanisms for the physical operation of the model vehicle 24 of the present embodiment. Actuating motor 188 serves to provide drive to rear wheels 191 (see FIG. 3) when activated. Actuator 192 as shown in FIG. 6 serves to provide vibrations to the model vehicle 24, simulating the vibration of a gasoline engine. Speaker 196 is used to generate race car sounds, such as engine idling, engine revving, gear shifting, engine malfunction, tire skidding and driver instructions. Circuit board 200 controls the logical flow of these operations and regulates voltage to mechanisms 188, 192 and 196. Further details will be provided hereinafter.

The mechanisms 188, 192 and 196 are employed when the user activates, for example, one of the activation points 108, 112, 116, 120 and 124. When activation occurs, for example, pressing the button 108, the present embodiment performs a series of functions: the race begin switch causes the speaker mechanism 196 to emit engine revving sounds, the mechanism 192 emits vibrations, and after a short delay, the actuating motor mechanism 188 provides drive to the rear wheels 191. Pressing the activation point 112 (the repair begins switch) causes speaker mechanism 196 to emit high RPM engine noises, followed by one of four malfunction noises corresponding to engine failure, empty fuel tank, loose stabilizing wing or flat front tires. The driver's voice then instructs the user to return to the pit to make suitable repairs. It will be understood that other malfunction noises and responses can be implemented in other embodiments.

In the case of engine failure, the user must remove the replacement engine 88 to a sufficient extent to activate an engine activation point (the engine switch). In case of an empty fuel tank, the user must actuate the activation button 116, preferably using the model gas can 72. If the tires are flat, the user must loosen the hex bolt 104, preferably using the hex wrench 76, to such an extent that the activation points 124 and 131 (the tire switches) are activated. If the vehicle wing 80 is loose, the user must loosen stabilizing the wing hex bolt 84 to such an extent that the activation point 120 (the stabilizing wing switch) is activated. If the user performs the correct operation successfully, the driver speaks an encouraging message, and motor mechanism 188 is activated, causing the model vehicle 24 to move, according to engine acceleration sounds provided through speaker device 196. If the user fails to make the correct repair within a certain time period, the driver speaks a warm but failure message, and the sequence is reset Of course, any imaginable variety of activation switches and accompanying functionalities can be used, according to the functions desired to be simulated by the manufacturer.

Figure 7:
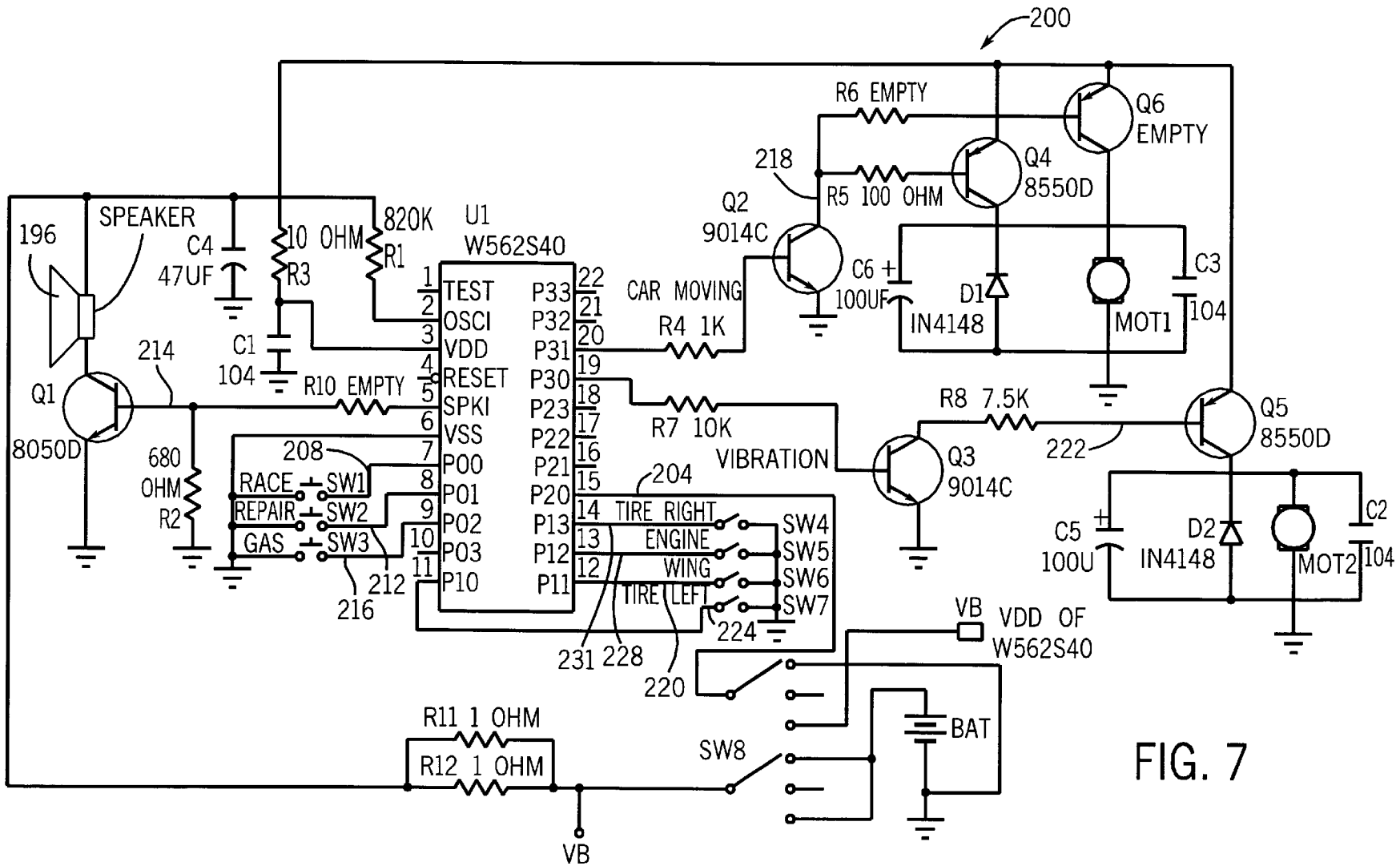
FIG. 7 is logical circuit diagram, showing an exemplary circuit of a model vehicle of a preferred embodiment.

FIG. 7 is a logical diagram of an exemplary circuit board 200 of the preferred embodiment. This is in addition to connections to the various devices 108, 112, 116, 120, 124, 188, 192, 196, and the like which are to be found in the logical presentation of circuit board 200, but are not entirely physically located on circuit board 200. The diagram of FIG. 7 can be roughly divided into four subcircuits. Subcircuit 204 consists of an integrated circuit, which provides memory and processing for pre-programmed functions via execution of one or more programs stored in memory. The subcircuit 204 includes a microcontroller 230 for processing the various signals in the system. In one embodiment of the invention, the microcontroller 230 is a W562S0 microcontroller, produced by Winbond Electronics Corp. It is possible, however, for other brands and varieties of microcontrollers to be used. Such chips are readily available, and can also be manufactured by those of ordinary skill in the art to a manufacturer's specification.

Subcircuit 204 provides episodic voltage control through various transistors to the three other subcircuits, depending on the state of inputs 208, 212, 216, 220, 224, and 231 (corresponding to the actuation of the activation points 108, 112, 116, 120, 124, and 131, respectively). Subcircuit 214 supplies current and provides cycle control for the speaker device 196. Subcircuit 218 periodically supplies current to the actuating motor device 188 depending on the output of the subcircuit 204. Subcircuit 222 provides current to actuator 192 to induce vibration.

While exemplary embodiments have been described and illustrated, numerous departures therefrom can be contemplated by persons skilled in the art. For example, the model vehicle might include a pre-programmed race course or a variety of different repair features. Therefore, the present invention is not limited to the foregoing description but only by the scope and spirit of the appended claims.

What is claimed is:

1. A model racing toy, comprising:

at least one model vehicle including at least one activation point, circuitry means for detecting user activation of the at least one activation point, and means for providing an audible response appropriate for the activation point which was detected as having been activated; and a model transport vehicle including a transport position, a storable deployment ramp, at least one attachable model vehicle accessory and means for converting from a transport vehicle to a model racing pit stop.

2. The model racing toy of claim 1, wherein the means for converting the transport vehicle to a model racing pit stop also deploys the storable deployment ramp.

3. The model racing toy of claim 2, wherein the model racing vehicle further comprises circuitry and at least one actuator to provide at least one of motion and action in response to an activation of the circuitry with means for providing a pre-programmed sequence of activation responses simulating at least one of a race and a vehicle repair sequence.

4. A model toy racing set, comprising:

a model racing vehicle; and a transport vehicle including model vehicle accessories that form a model racing pit stop, a deployment ramp slidably attached and stored inside the transport vehicle, an actuating device positioned near the deployment ramp in its fully closed position, such that activation of the actuating device moves the deployment ramp to a deployed position, wherein the actuating device is activated by a button and reset through the deployment ramp being movably disposed within the transport vehicle, whereby the racing vehicle is loaded on and off the transport vehicle in a smooth rolling motion.

5. The toy racing set of claim 4, wherein said toy racing set includes means for conversion of the transport vehicle into the model racing pit stop.

6. The toy racing set of claim 4, wherein the model racing vehicle further comprises one or more activation points, said activation points to be activated by a user, circuitry to detect activation and lack thereof and means for providing an audible response appropriate for user action.

7. The toy racing set of claim 6, further comprising means for activating the activation points.

* * * * *